US011175020B2

(12) United States Patent
Su et al.

(10) Patent No.: US 11,175,020 B2
(45) Date of Patent: Nov. 16, 2021

(54) LIGHTING APPARATUS

(71) Applicant: XIAMEN ECO LIGHTING CO. LTD., Xiamen (CN)

(72) Inventors: Zecang Su, Xiamen (CN); Huangbin Gan, Xiamen (CN); Haiqiang Chen, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/847,354

(22) Filed: Apr. 13, 2020

(65) Prior Publication Data

US 2020/0332987 A1 Oct. 22, 2020

(30) Foreign Application Priority Data

Apr. 19, 2019 (CN) ..... 201920542758.6

(51) Int. Cl.
*F21V 15/015* (2006.01)
*F21V 17/16* (2006.01)
*F21Y 115/10* (2016.01)

(52) U.S. Cl.
CPC ..... *F21V 15/015* (2013.01); *F21V 17/164* (2013.01); *F21Y 2115/10* (2016.08)

(58) Field of Classification Search
None
See application file for complete search history.

(56) References Cited

U.S. PATENT DOCUMENTS 2,647,984 A * 8/1953 Falge ..... F21V 17/16 362/374
2012/0140480 A1* 6/2012 Taniuchi ..... F21V 23/006 362/296.01
2013/0003369 A1* 1/2013 Hiraoka ..... F21V 17/002 362/231
2016/0234414 A1* 8/2016 Chen ..... F21V 23/003
2017/0254487 A1* 9/2017 Matsubayashi ..... G02B 6/0031
2020/0340659 A1* 10/2020 Huang ..... F21V 25/00
2020/0348016 A1* 11/2020 Liu ..... F21V 17/02
2020/0359478 A1* 11/2020 Hou ..... H05B 45/30

FOREIGN PATENT DOCUMENTS

CN 206846502 U * 1/2018
CN 209926156 U * 1/2020 ..... F21V 17/164
DE 102010004999 B4 * 3/2012 ..... F21V 17/164

* cited by examiner

*Primary Examiner* — Britt D Hanley
(74) *Attorney, Agent, or Firm* — Chun-Ming Shih; Lanway IPR Services

(57) ABSTRACT

A lighting apparatus includes a light passing cover, a rim structure and a pressing structure. The light passing cover has a peripheral edge, a central part and a reverse curve surface. The reverse curve surface is extended from the peripheral edge. The central part allowing a light source to emit a light to pass through. The rim structure has a socket, a peripheral wall, and a bottom edge. The pressing structure is made of an elastic strip bent to form a top portion, a middle portion and a root portion. The root portion is kept in the socket. The middle portion presses the reverse curve surface of the light passing cover with an elastic force of the elastic strip to keep the light passing cover staying between the middle portion and the bottom edge of the rim structure.

20 Claims, 8 Drawing Sheets

Fig.. 7

LIGHTING APPARATUS

FIELD

The present invention is related to a lighting apparatus, and more particularly related to a lighting apparatus with easy component assembly.

BACKGROUND

Electroluminescence, an optical and electrical phenomenon, was discover in 1907. Electroluminescence refers the process when a material emits light when a passage of an electric field or current occurs. LED stands for light-emitting diode. The very first LED was reported being created in 1927 by a Russian inventor. During decades' development, the first practical LED was found in 1961, and was issued patent by the U.S. patent office in 1962. In the second half of 1962, the first commercial LED product emitting low-intensity infrared light was introduced. The first visible-spectrum LED, which limited to red, was then developed in 1962.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

With high light output, LEDs are available across the visible, infrared wavelengths, and ultraviolet lighting fixtures. Recently, there is a high-output white light LED. And this kind of high-output white light LEDs are suitable for room and outdoor area lighting. Having led to new displays and sensors, LEDs are now be used in advertising, traffic signals, medical devices, camera flashes, lighted wallpaper, aviation lighting, horticultural grow lights, and automotive headlamps. Also, they are used in cellphones to show messages.

A Fluorescent lamp refers to a gas-discharge lamps. The invention of fluorescent lamps, which are also called fluorescent tubes, can be traced back to hundreds of years ago. Being invented by Thomas Edison in 1896, fluorescent lamps used calcium tungstate as the substance to fluoresce then. In 1939, they were firstly introduced to the market as commercial products with variety of types.

In a fluorescent lamp tube, there is a mix of mercury vapor, xenon, argon, and neon, or krypton. A fluorescent coating coats on the inner wall of the lamp. The fluorescent coating is made of blends of rare-earth phosphor and metallic salts. Normally, the electrodes of the lamp comprise coiled tungsten. The electrodes are also coated with strontium, calcium oxides and barium. An internal opaque reflector can be found in some fluorescent lamps. Normally, the shape of the light tubes is straight. Sometimes, the light tubes are made circle for special usages. Also, u-shaped tubes are seen to provide light for more compact areas.

Because there is mercury in fluorescent lamps, it is likely that the mercury contaminates the environment after the lamps are broken. Electromagnetic ballasts in fluorescent lamps are capable of producing buzzing mouse. Radio frequency interference is likely to be made by old fluorescent lamps. The operation of fluorescent lamps requires specific temperature, which is best around room temperature. If the lamps are placed in places with too low or high temperature, the efficacy of the lamps decreases.

In real lighting device design, details are critical no matter how small they appear. For example, to fix two components together conveniently usually brings large technical effect in the field of light device particularly when any such design involves a very large number of products to be sold around the world.

SUMMARY

In some embodiments, a lighting apparatus, includes a light passing cover, a rim structure and a pressing structure.

The light passing cover has a peripheral edge, a central part and a reverse curve surface. The reverse curve surface is extended from the peripheral edge. The central part allowing a light source to emit a light to pass through.

The rim structure has a socket, a peripheral wall, and a bottom edge. The pressing structure is made of an elastic strip bent to form a top portion, a middle portion and a root portion. The root portion is kept in the socket. The middle portion presses the reverse curve surface of the light passing cover with an elastic force of the elastic strip to keep the light passing cover staying between the middle portion and the bottom edge of the rim structure.

In some embodiments, the top portion of the pressing structure has an opposite curve direction as the middle portion of the pressing structure.

In some embodiments, the top portion of the pressing structure keeps a distance from the light passing cover when the middle portion of the pressing structure engages the light passing cover.

In some embodiments, the top portion of the pressing structure allows a user to press to keep the middle portion of the pressing structure away from contact to the light passing cover to detach the light passing cover from the rim structure.

In some embodiments, the top portion of the pressing structure has a U-shape structure by bending the elastic strip.

In some embodiments, the middle portion of the pressing structure includes two parallel strip portions.

In some embodiments, the root portion of the pressing structure has a cross structure using an elastic force to keep the pressing structure staying in the socket.

In some embodiments, the socket has a reverse hook structure to keep the root portion of the pressing structure to keep in the socket when the root portion is deformed and inserted into the socket.

In some embodiments, the light source is mounted on a metal plate, the metal plate is heat connected to the peripheral wall, the peripheral wall is made of metal material.

In some embodiments, the light source has a hook structure for fixing the light passing cover.

In some embodiments, the reverse cover surface of the light passing cover is made of a heat dissipation material and the reverse curve surface routes heat of the light source to the pressing structure and then to the peripheral wall of the rim structure.

In some embodiments, there is a pad fixing to the middle portion of the pressing structure for adding friction when using the pad pressing the reverse curve surface.

In some embodiments, the peripheral wall has a light passing window.

In some embodiments, a second light source emits light through the light passing window of the peripheral wall.

In some embodiments, the reverse curve surface of the light passing cover has a reflection layer in an inner surface of the light passing cover.

In some embodiments, there are two pressing structures disposed on opposite sides of the rim structure.

In some embodiments, there are tree pressing structures disposed on three symmetric positions of the rim structure.

In some embodiments, there is an extending base disposed on the peripheral wall for installing an attached function module.

In some embodiments, the attached function module is a speaker and there is a sound exit hole on the peripheral wall of the rim structure.

In some embodiments, in the attached module is a Wi-Fi hot spot device.

DETAILED DESCRIPTION

Figure 6:
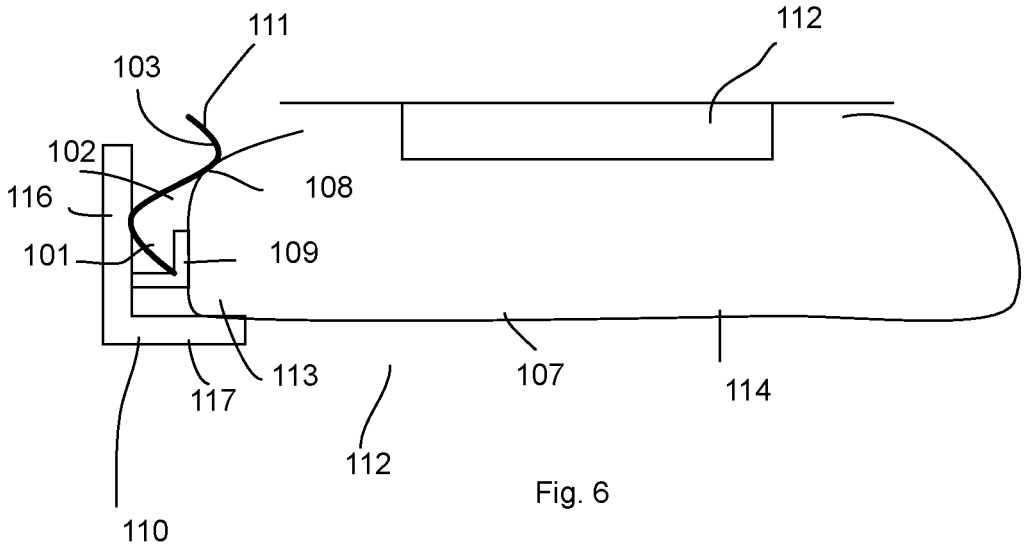
FIG. 6 shows components in a side view.

In FIG. 6, a lighting apparatus, includes a light passing cover, a rim structure and a pressing structure.

The light passing cover 107 has a peripheral edge 113, a central part 114 and a reverse curve surface 108. The reverse curve surface 108 is extended from the peripheral edge 113. The central part allowing a light source to emit a light to pass through.

The rim structure 110 has a socket 109, a peripheral wall 116, and a bottom edge 117. The pressing structure 111 is made of an elastic strip bent to form a top portion 103, a middle portion 102 and a root portion 101. The root portion 101 is kept in the socket 109. The middle portion 102 presses the reverse curve surface 108 of the light passing cover 107 with an elastic force of the elastic strip to keep the light passing cover 107 staying between the middle portion 102 and the bottom edge 117 of the rim structure.

In some embodiments, the top portion of the pressing structure has an opposite curve direction as the middle portion of the pressing structure.

In some embodiments, the top portion of the pressing structure keeps a distance from the light passing cover when the middle portion of the pressing structure engages the light passing cover.

In some embodiments, the top portion of the pressing structure allows a user to press to keep the middle portion of the pressing structure away from contact to the light passing cover to detach the light passing cover from the rim structure.

In some embodiments, the top portion of the pressing structure has a U-shape structure by bending the elastic strip.

In some embodiments, the middle portion of the pressing structure includes two parallel strip portions.

In some embodiments, the root portion of the pressing structure has a cross structure using an elastic force to keep the pressing structure staying in the socket.

In some embodiments, the socket has a reverse hook structure to keep the root portion of the pressing structure to keep in the socket when the root portion is deformed and inserted into the socket.

In some embodiments, the light source 882 is mounted on a metal plate 883, the metal plate 883 is heat connected to the peripheral wall 884, the peripheral wall is made of metal material.

In some embodiments, the light source 882 has a hook structure 881 for fixing the light passing cover 885.

In some embodiments, the reverse cover surface of the light passing cover is made of a heat dissipation material and the reverse curve surface routes heat of the light source to the pressing structure and then to the peripheral wall of the rim structure.

Figure 8:
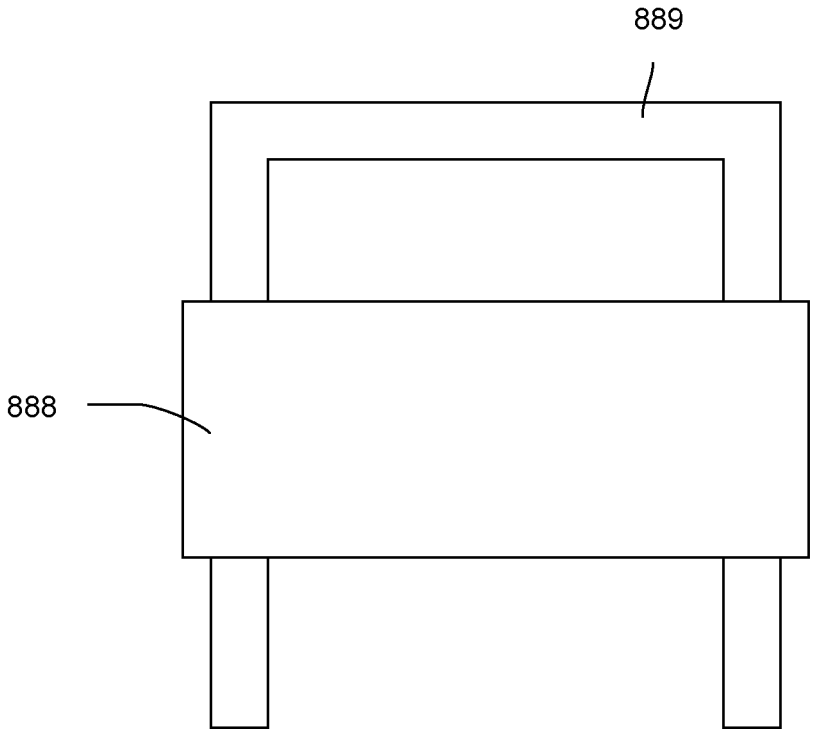
FIG. 8 shows another example of a pressing structure.

In FIG. 8, there is a pad 888 fixing to the middle portion of the pressing structure 889 for adding friction when using the pad pressing the reverse curve surface.

Figure 7:
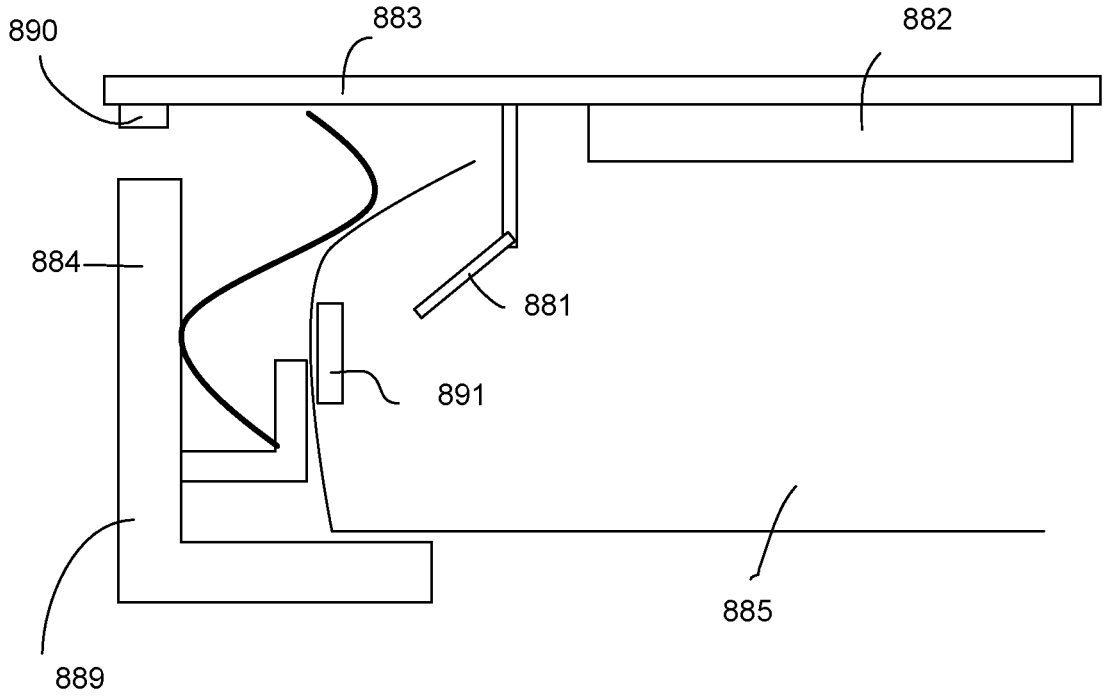
FIG. 7 shows another embodiment.

In FIG. 7, the peripheral wall has a light passing window 889

In FIG. 7, a second light source 890 emits light through the light passing window 889 of the peripheral wall.

In FIG. 7, the reverse curve surface of the light passing cover has a reflection layer 891 in an inner surface of the light passing cover.

In some embodiments, there are two pressing structures disposed on opposite sides of the rim structure.

In some embodiments, there are tree pressing structures disposed on three symmetric positions of the rim structure.

In some embodiments, there is an extending base disposed on the peripheral wall for installing an attached function module.

In some embodiments, the attached function module is a speaker and there is a sound exit hole on the peripheral wall of the rim structure.

In some embodiments, in the attached module is a Wi-Fi hot spot device.

Figure 1:
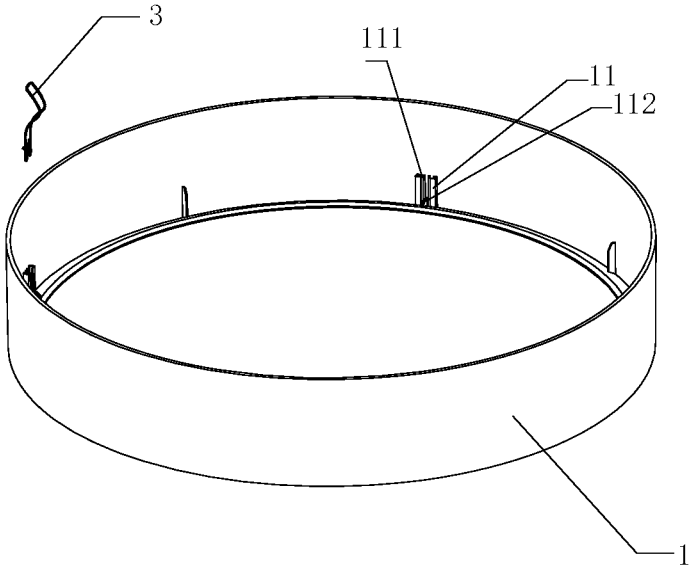
FIG. 1 shows a lighting apparatus embodiment.

In FIG. 1, a rim part 1 has a socket 11, with a guiding groove 111 and a limiting block 112. The pressing structure 3 has a root part being inserted into the guiding groove 111 and is fixed to the socket 11.

Figure 2:
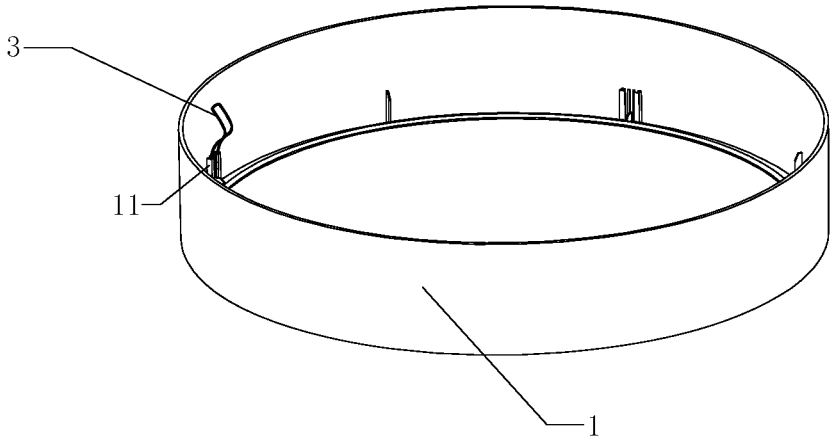
FIG. 2 shows another status of the embodiment in FIG. 1.

FIG. 2 shows the pressing structure 3 inserted into the socket 11 of the rim part 1.

Figure 3:
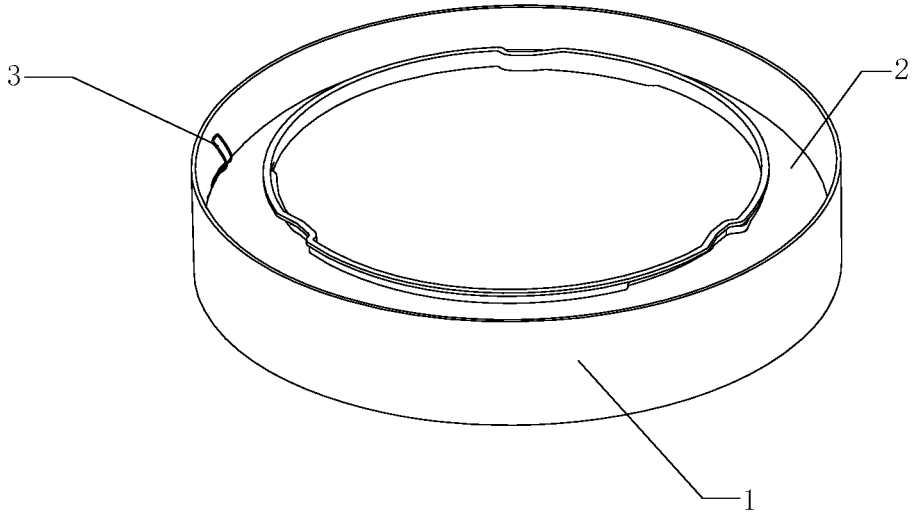
FIG. 3 shows another component being installed to the example of FIG. 1.

FIG. 3 shows a light passing cover 2 being fixed to the rim part 1 by the pressing structure 3.

Figure 4:
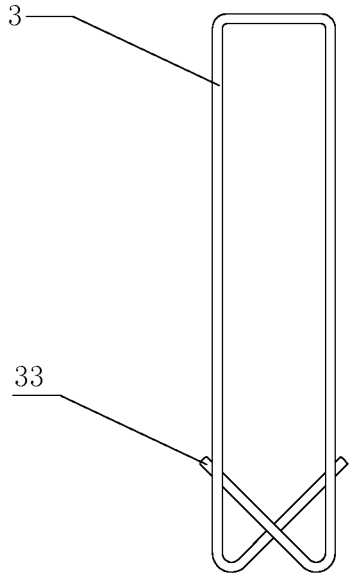
FIG. 4 shows an example of a pressing structure.

FIG. 4 shows a pressing structure 3 with a cross structure 33 as its root portion.

Figure 5:
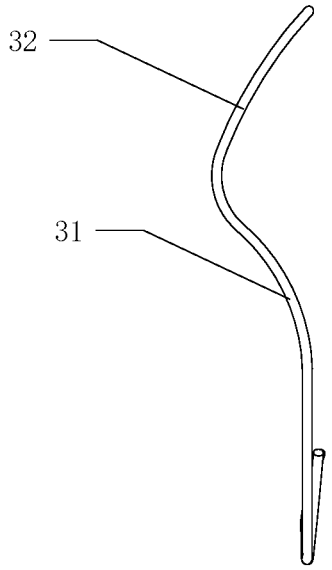
FIG. 5 shows a side view of a pressing structure.

FIG. 5 shows a top portion 32 is provided for users to pull to deform the middle portion 31 of the pressing part to insert the light passing cover.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus, comprising:

a light passing cover having a peripheral edge, a central part and a reverse curve surface extended from the peripheral edge, the central part allowing a light source to emit a light to pass through;

a rim structure having a socket, a peripheral wall, and a bottom edge, wherein the socket is disposed on an inner side of the peripheral wall; and a pressing structure made of an elastic strip bent to form a top portion, a middle portion and a root portion, the root portion being kept in the socket, the middle portion pressing the reverse curve surface of the light passing cover with an elastic force of the elastic strip to keep the light passing cover staying between the middle portion and the bottom edge of the rim structure.

2. The lighting apparatus of claim 1, wherein the top portion of the pressing structure has an opposite curve direction as the middle portion of the pressing structure.

3. The lighting apparatus of claim 1, wherein the top portion of the pressing structure keeps a distance from the light passing cover when the middle portion of the pressing structure engages the light passing cover.

4. The lighting apparatus of claim 1, wherein the top portion of the pressing structure allows a user to press to keep the middle portion of the pressing structure away from contact to the light passing cover to detach the light passing cover from the rim structure.

5. The lighting apparatus of claim 1, wherein the top portion of the pressing structure has a U-shape structure by bending the elastic strip.

6. The lighting apparatus of claim 1, wherein the middle portion of the pressing structure comprises two parallel strip portions.

7. The lighting apparatus of claim 1, wherein the root portion of the pressing structure has a cross structure using an elastic force to keep the pressing structure staying in the socket.

8. The lighting apparatus of claim 7, wherein the socket has a reverse hook structure to keep the root portion of the pressing structure to keep the root portion of the pressing structure to keep in the socket when the root portion is deformed and inserted into the socket.

9. The lighting apparatus of claim 1, wherein the light source is mounted on a metal plate, the metal plate is heat connected to the peripheral wall, the peripheral wall is made of metal material.

10. The lighting apparatus of claim 1, wherein the light source has a hook structure for fixing the light passing cover.

11. The lighting apparatus of claim 1, wherein the reverse cover surface of the light passing cover is made of a heat dissipation material and the reverse curve surface routes heat of the light source to the pressing structure and then to the peripheral wall of the rim structure.

12. The lighting apparatus of claim 1, wherein there is a pad fixing to the middle portion of the pressing structure for adding friction when using the pad pressing the reverse curve surface.

13. The lighting apparatus of claim 1, wherein the peripheral wall has a light passing window.

14. The lighting apparatus of claim 13, wherein a second light source emits light through the light passing window of the peripheral wall.

15. The lighting apparatus of claim 1, wherein the reverse curve surface of the light passing cover has a reflection layer in an inner surface of the light passing cover.

16. The lighting apparatus of claim 1, wherein there are two pressing structures disposed on opposite sides of the rim structure.

17. The lighting apparatus of claim 1, wherein there are three pressing structures disposed on three symmetric positions of the rim structure.

18. The lighting apparatus of claim 1, wherein an attached function module is installed on the peripheral wall.

19. The lighting apparatus of claim 18, wherein the attached function module is a speaker and there is a sound exit hole on the peripheral wall of the rim structure.

20. The lighting apparatus of claim 18, wherein in the attached module is a Wi-Fi hot spot device.

* * * * *